US005800312A

United States Patent [19]

Ormondroyd

[11] Patent Number: 5,800,312

[45] Date of Patent: Sep. 1, 1998

[54] GOALIE TRAINING APPARATUS AND METHOD OF USING A GOALIE TRAINING APPARATUS

[75] Inventor: Thomas Ormondroyd, Worcester, Mass.

[73] Assignee: Sportstec Concepts, Inc., Worcester, Mass.

[21] Appl. No.: 741,368

[22] Filed: Oct. 30, 1996

[51] Int. Cl.[6] ..... A63B 23/04

[52] U.S. Cl. ..... 482/51; 482/70; 482/71

[58] Field of Search ..... 482/51, 52, 473; 434/247, 255; 473/132, 480

[56] References Cited

U.S. PATENT DOCUMENTS

| | | | |
|---|---|---|---|
| 4,779,862 | 10/1988 | Keppler . | |
| 4,940,226 | 7/1990 | Carra . | |
| 5,076,571 | 12/1991 | Croce, Jr. et al. . | |
| 5,114,387 | 5/1992 | Keppler . | |
| 5,249,797 | 10/1993 | Dowhy | 273/57.2 |
| 5,342,260 | 8/1994 | Markland . | |
| 5,352,165 | 10/1994 | Koblick . | |
| 5,393,282 | 2/1995 | MacLean . | |
| 5,465,958 | 11/1995 | Brun | 273/57.2 |
| 5,509,650 | 4/1996 | MacDonald | 273/26 R |
| 5,509,870 | 4/1996 | Lloyd . | |

OTHER PUBLICATIONS

Super-Slide of Minnesota brochure for Artificial Ice Sheet (Summer 1996).

*Primary Examiner*—Jerome Donnelly
*Attorney, Agent, or Firm*—Connolly & Hutz

[57] ABSTRACT

A goalie training apparatus has a first plurality of semi-circular wedge-shaped barriers attached to an upper glide surface of a slide board along an arc and at least one other barrier attached to the upper glide surface separated from the first plurality of barriers leaving a portion of the glide surface unobstructed. The arcuate faces of the barriers present multi-angular push-off points important for goalie training, as goalies must move in various directions within the goal crease. The barriers are preferably attached to the glide surface with high strength hook and loop fasteners, possibly in combination with bolts, screws or rivets. Wearing a foot covering with a low coefficient of friction in relation to the glide surface, a goalie stands atop the unobstructed glide surface and pushes a foot against one barrier and glides or shuffles along the glide surface to another barrier/push point. The second barrier may be a plurality of barriers and represents the goal or goal posts. The first plurality of barriers represent target points in front of a goal that are important for goalies practicing "going out" and "cutting down" angles.

19 Claims, 3 Drawing Sheets

10
12
22
22
14
16
24

12
22
18
22
30
22
10
16
28
26
14

14
12
16
14

GOALIE TRAINING APPARATUS AND METHOD OF USING A GOALIE TRAINING APPARATUS

BACKGROUND OF THE INVENTION

Slide board exercise devices were developed primarily as off-ice exercise training apparatus for speed skaters. The basic slide board exercise apparatus has a rectangular base covered with a plastic sheet. The plastic sheet has a smooth glide surface and is bounded at two sides by a raised straight-edged bumper. The bumpers are attached to opposite ends of the base. A person wearing socks or other low resistance foot covering slides along the plastic sheet until one foot contacts a bumper. By pushing with the leg contacting the first straight-edged bumper, the person then slides along the plastic sheet toward the opposite bumper. By alternately pushing off one bumper towards the other bumper, the person simulates the side-to-side motion of ice skating, particularly speed skating. Typical slide board exercise devices are shown in U.S. Pat. Nos. 4,779,862 and 5,114,387 to Keppler, and 5,076,571 to Croce, Jr. et al. Alternate means for attaching the side bumpers are disclosed in U.S. Pat. No. 5,342,260 to Markland.

U.S. Pat. Nos. 4,940,226 to Carra and 5,352,165 to Koblick show portable slide exercise devices in which the slide surface may be rolled up for storage.

U.S. Pat. No. 5,393,282 to Maclean notes that the majority of slide board exercise apparatus are bounded at two opposing sides and limit the user's training motion to lateral or side-to-side movement. Accordingly, Maclean alternately proposes attaching straight-edged bumpers to a slide board in a configuration that forms an enclosed space. With an enclosed space, the user is completely surrounded by straight-edged bumper boundaries and may push off and move front to back, side to side or diagonally. For this alternate embodiment, Maclean shows eight straight-edged bumpers arranged to form an octagon. See also, U.S. Pat. No. 5,509,870 to Lloyd.

Other similated ice surfaces are available. Various stick handling and puck shooting training apparatus are offered to hockey players. SUPER-SLIDE of Minnesota offers artificial ice sheets formed from UV-treated plastics. Canada patent publication CA 2060969-A discloses a styrene sheet with an imprinted design for hockey players to practice stick handling and puck shooting.

None of the prior art slide board exercise apparatus or artificial ice surface apparatus provide an off-ice training apparatus specifically designed for goal-tenders. The prior apparatus are limited to straight-edged barriers and do not meet the specific training needs of goalies. Hockey goalies require great stamina to maintain optimum performance throughout a game. Because goalie equipment is heavy, goalies require great leg strength. While goalies might practice saving shots when another player uses a puck shooting apparatus, none of the prior office exercise apparatus assist a goalie to strengthen all of the proper muscles a goalie needs to move around the goal crease. Specific motions, not limited to side-to-side or front-to-back, must be practiced. An off-ice training apparatus for goalies with pushpoints or barriers with multi-angular faces would provide the unlimited opportunity to practice goalie angles, i.e. coming out and cutting down angles, and to strengthen those leg muscles important to goal-tending.

SUMMARY OF THE INVENTION

A hockey goalie training apparatus especially designed to exercise leg muscles and practice angles important for goal-tending is formed with a slide board having an upper glide surface and various attached barriers with multi-angular faces. The slide board may be attached to a solid mounting surface. The barriers are positioned in specific configurations and act as push off points while training on the apparatus. A first plurality of barriers is attached to the glide surface in spaced-apart relation along an arc. A single arcuate barrier with painted or imprinted target points thereon also might be used. The first plurality of barriers represents foot targets for a goalie to use when practicing coming-out and cutting down angles important for goal-tending. In the preferred embodiment, the arc is located near the front edge of the apparatus.

One second barrier or a second plurality of barriers are attached to the glide surface and is/are separated from the first plurality of barriers leaving a portion of the slide surface of the slide board unobstructed. The unobstructed portion represents the goal crease. If a plurality of barriers is used, the second plurality of barriers represent the goal posts. The second plurality of barriers are attached to the glide surface in spaced-apart relation along a substantially straight line. In the preferred embodiment, the second plurality of barriers are positioned adjacent to the back edge of the slide board.

A goalie using the training device stands atop the glide surface of the slide board on the portion of the surface unobstructed by barriers. The goalie wears a foot covering that has a low coefficient of friction in relation to the glide surface of the slide board so that the wearer may slide on the glide surface. Usually nylon boots that cover shoes or ordinary socks work well. Training begins by pushing one foot off one barrier/push point and sliding or shuffling to another barrier/push point. The goalie may slide side to side between the barriers in the second plurality of barriers representing the goal posts. The goalie may slide between barriers of the first plurality of barriers and barriers of the second plurality of barriers. The goalie also may slide only between barriers of the first plurality of barriers and barriers of the second plurality of barriers. A variety of training exercises may be developed for the goalie to practice the movements to certain angles important for goal tending. All such exercises build muscles and improve stamina in a manner not possible with known slide board exercisers and puck shooting surfaces.

The first plurality of barriers preferably are separate barriers spaced apart from one another along an arc. While not required, an arc representing the outer boundary of the goal crease may be colored (taped or vinyl or painted) on the glide surface of the slide board, and the first plurality of barriers may be attached to the glide surface on or adjacent to the colored arc. Any suitable attachment means may be used. High strength hook and loop fasteners (VELCRO®) are preferred. Such fasteners permit barrier removal for storage. In addition, the risk of injury may be reduced because the barriers can separate from the glide surface when subjected to excessive force.

The second barrier or plurality of barriers may be attached by any suitable attachment means. Preferably, high strength hook and loop fasteners (VELCRO®) are used in combination with bolts. The second plurality of barriers represents the goal posts. One or more back stop barriers may be attached to the glide surface in the space between the barriers in the second plurality of barriers.

DESCRIPTION OF THE PREFERRED EMBODIMENT

Figures 1, 2, 3:
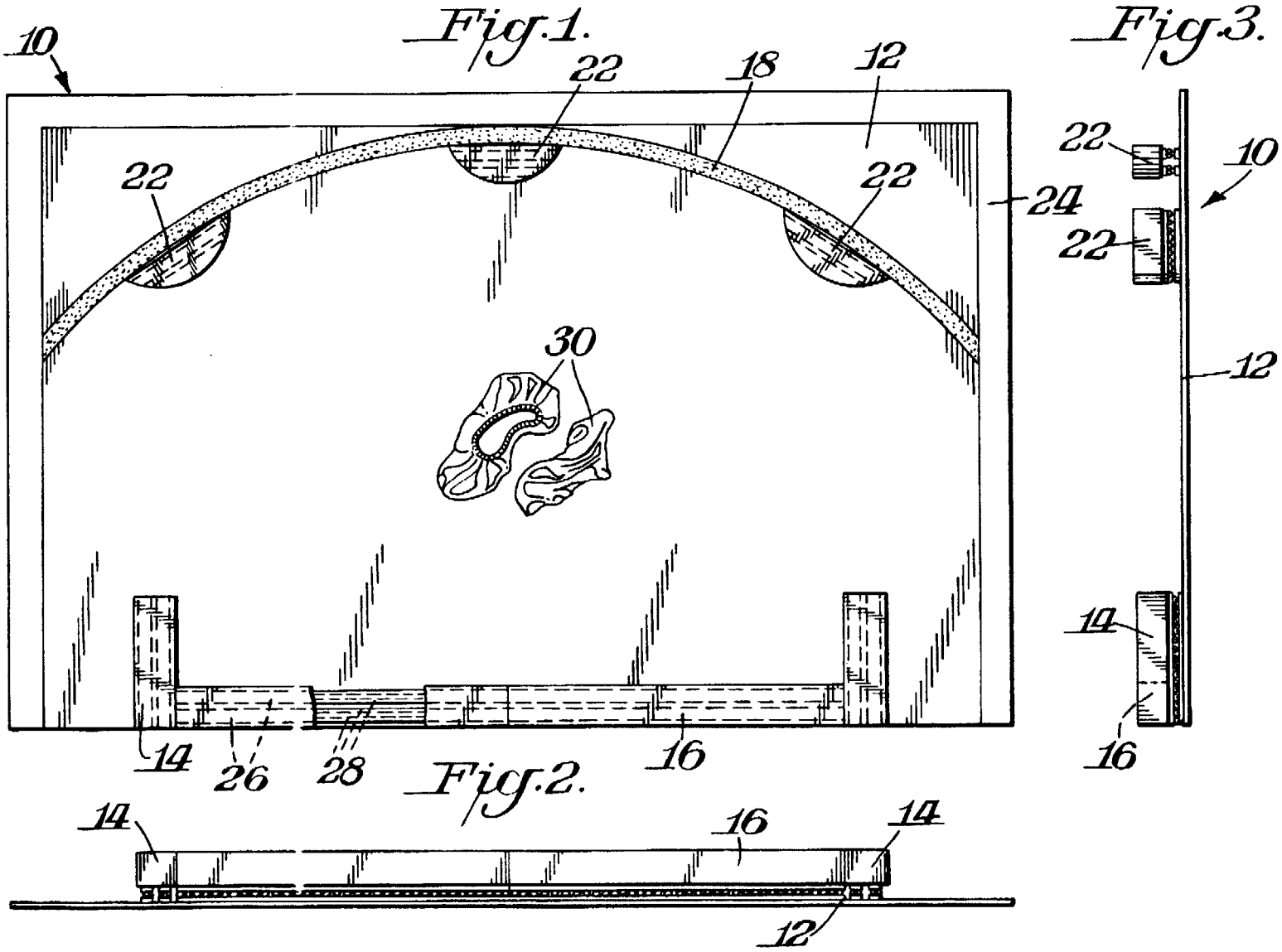
FIG. 1 is a top plan view of a goalie training apparatus of the invention.
FIG. 2 is a front elevational view of the goalie training apparatus of FIG. 1.
FIG. 3 is a right side elevational view of the goalie training apparatus of FIGS. 1–2.

As shown in FIG. 1, the goalie training apparatus 10 of this invention includes a slide board 12 with an upper gliding surface. In the preferred embodiment, the slide board is about eight (8) to nine (9) feet long and five (5) to six (6) feet wide with a one-sixteenth-inch (1/16) to one-eighth-inch (1/8) thickness. Any material suitable for slide board exercise apparatus may be used. I have found KOMATEX™ plastic works well for this application.

Figure 4:
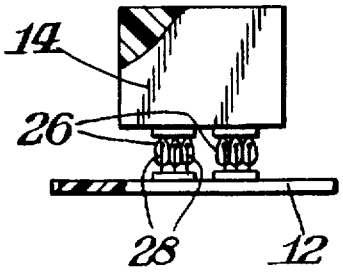
FIG. 4 is an enlarged fragmental end elevational view of a post attached to the board apparatus.

Various barriers or push points are mounted or attached to the glide surface of the slide board 12. Post barriers 14 are attached along a first lengthwise edge of the upper glide surface with bolts or rivets (not shown) and strips of high strength hook and loop fasteners 26, 28 (see FIG. 4). Hook and loop fasteners sold as GORILLA VELCRO® brand work well. One post barrier 14 is positioned preferably about one (1) to two (2) feet from the side edge and adjacent to the first lengthwise (back) edge of the slide board. The other barrier 14 is positioned about one (1) to two (2) feet from the other side edge and adjacent to the first lengthwise (back) edge of the slide board. The post barriers 14 are spaced apart from one another about six (6) feet. They represent the goal posts of a hockey goal.

Figure 1A:
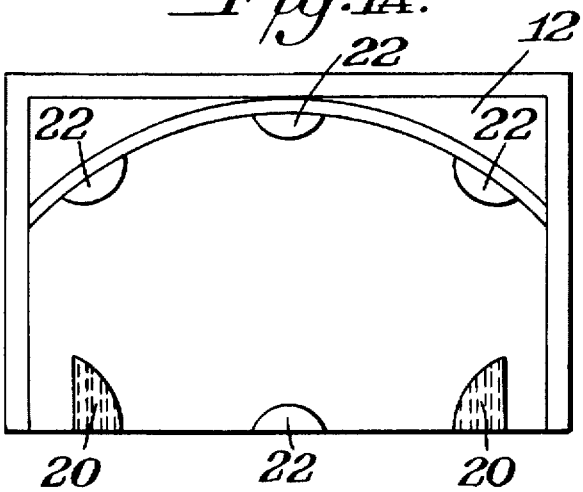
FIG. 1A is a top plan view of an alternate arrangement of the goalie training apparatus of the invention.
Figure 7:
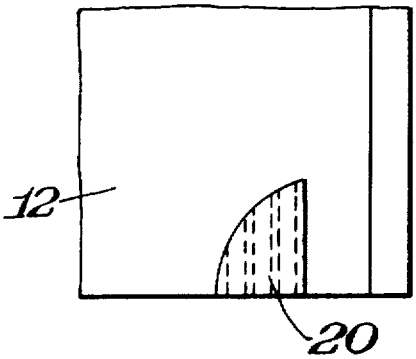
FIG. 7 is a fragmental top plan view of a slide board and attached semi-circular post.
Figure 8:
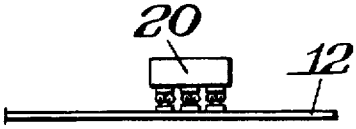
FIG. 8 is a fragmental front elevational view of the slide board and attached semi-circular post of FIG. 7.

Preferably, as shown in FIG. 1 the post barriers 14 have a four (4) to six-inch (6) thickness, a one-and-one half (1.5) to two-inch (2) height, and a ten (10) to twelve-inch (12) length. They may be rectangular as shown in FIG. 1 or semi-circular sectional shaped as shown in FIGS. 1A, 7 and 8. If semi-circular shaped, the post barriers have a four-and-one-half (4.5) to six-and-one-half-inch (6.5) thickness, and a ten (10) to eleven-inch (11) length. Any suitable material that will withstand the pushing forces during training exercises may be used to form the post barriers. I have found that wooden blocks, or wooden blocks covered with nylon, leather, foam, urethane or rubber work well. Instead of wood, an engineered thermoplastic resin may also be used.

In an alternate construction shown in FIGS. 7 and 8, the post barriers 20 have a rounded or arcuate push point face surface. If two post barriers 20 are used, they are mounted to the glide surface 12 separated from one another and in parallel relation with the rounded surfaces of the post barriers 20 facing towards each other. The rounded surfaces form multi-angular push points important for goalie training. The goalie may practice t-gliding in multiple directions, whereas straight-edged push points limit the direction of glide travel. The edges of the rounded faces of the post barriers should not be sharply pointed and may be beveled for greater safety.

One or more back stop barriers 16 may be attached to the glide surface between the post barriers 14 or 20. The back stop barriers 16 shown in FIG. 1 are attached to the glide surface with strips of hook and loop strip fasteners 26, 28. They are formed from the same material suitable for forming the post barriers. They are each about three (3) feet long, two (2) to three-inches (3) wide and one-and-one-half (1.5) to two-inches (2) high. Alternatively, as shown in FIG. 1A, one or more back stop barrier(s) may be shaped similarly to other barriers 22 attached to the glide surface of the slide board. Such alternate back stop barriers 22 are along the line formed directly between the post barriers 14 or 20.

A red arc 18 is colored (taped) to the upper glide surface of the slide board and a blue boundary 24 is colored (taped) on outer edges of the board surface. The red arc line 18 represents the edge of the goal crease. Typically a goal crease arc represents an arc segment formed from a circle with a radius of between about four (4) and six (6) feet, preferably five (5) feet, where the center point of the circle is positioned behind the goal net.

Figure 5:
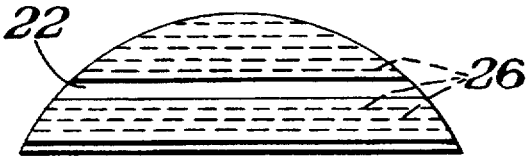
FIG. 5 is an enlarged bottom plan view of a semi-circular blocker with attached fastener strips.

As shown in FIGS. 1 and 1A, on the glide surface between the arc 18 and the post barriers 14 several blocker barriers 22 are attached. Preferably, the barriers 22 are attached to the glide surface of the slide board in an arc pattern and spaced apart from one another. In the preferred embodiment, the barriers 22 are attached adjacent to or on the arc line 18 using strips of high strength hook and loop fasteners (see FIG. 5).

The semi-circular wedge-shaped blocker barriers 22 are formed from wood, engineered thermoplastic materials, or wood or plastic coated or covered with nylon, leather, rubber or foam. Preferably each blocker barrier 22 has a length of about nine (9) to sixteen (16) inches, preferably twelve (12) inches, a width of about three (3) to four (4) inches, preferably three and one half (3.5) inches, and a height of about one (1) to two (2) inches, preferably one and one half (1.5) inches. The arcuate or semi-circular faces of the barriers form rounded or multi-angular push points important for goalie training. These multi-angular push points make it possible for the goalie to practice t-gliding in multiple directions, whereas straight-edged push points limit the direction of glide travel. The edges of the semi-circular faces of the barriers should not be sharp and may be beveled for greater safety.

The middle barrier 22 is positioned at the central portion of the arc and about three and one half (3.5) to four (4) feet from the first lengthwise (back) edge and only about six (6) to twelve (12) inches from the second lengthwise (front) edge of the slide board. The other barriers 22 shown in FIGS. 1 and 1A are positioned about three (3) to four (4) feet from the back edge of the slide board and from about one (1) to two (2) feet from the front edge.

Figure 9:
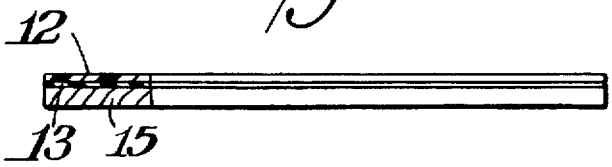
FIG. 9 is a front elevational view of a slide board with a rigid backing.

When the barriers 22 are removed, the slide board 12 may be rolled for storage. Alternatively, as shown in FIG. 9, the slide board 12 may be attached to a solid mounting surface 15. Such embodiment with solid mounting surface permits the goalie training apparatus to be used on various unlevel and uneven support surfaces, such as gravel driveways and turf. The solid mounting surface 15 may be a sheet of plywood, laminate board or engineered thermoplastic with a thickness of 3/8 to 1/2 inch. A rubber frictional coating adhesive 13 may be applied to the bottom surface of the slide board 12 to attach it to the solid mounting surface.

Alternatively, the slide board might be attached to the solid mounting surface with bolts, screws, rivets or other mechanical attaching means.

When training on the goalie training apparatus, the goalie wears footwear with a low coefficient of friction relative to the glide surface of the slide board. Nylon booties 30 may be worn over shoes or socks. Some ordinary cotton socks may be suitable.

The goalie may perform various drills to strengthen leg muscles and practice goal tending movements with the goalie training apparatus. Goalie training differs from speed skating training or other skating training. For instance, goalies must practice moving on the ice in the goal crease while keeping the body low. While in a goalie stance, the goalie will be in a crouched position with bent knees and head up. The goalie maintains this goalie stance even while moving about the goal crease.

Several representative training drills are shown in FIGS. 6A–F. The starting point(s) are represented by Ⓢ in the figures. The paths of travel/slide are represented by dotted lines 32.

Figure 6A:
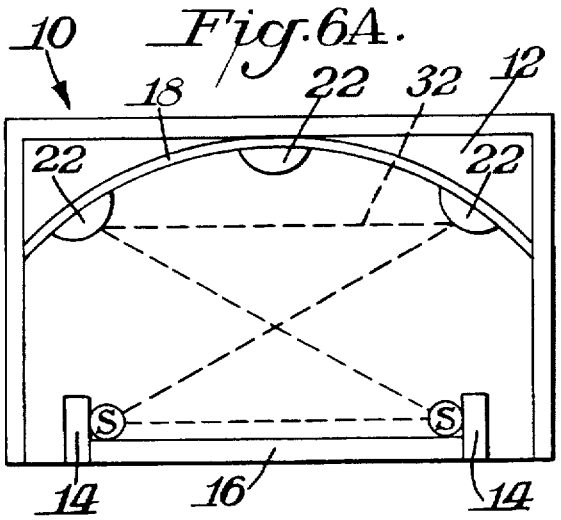
FIGS. 6A–6F show the goalie training apparatus with representative exercise training patterns.

Referring to FIG. 6A, a drill to practice moving around the perimeter of the goal crease is shown. The goalie practices moving from point to point and from point to corner post. The goalie begins by standing on the glide surface of the slide board 12 adjacent to one post barrier blocker 14. The goalie then pushes one foot off the post barrier 14 and t-glides in a diagonal direction to a far semi-circular blocker 22. Angled or multi-angled blocker barrier surfaces are often preferred for a proper goalie t-glide. Therefore, the post barrier blocker 20 shown in FIGS. 7 and 8 may be preferred. Once reaching the blocker barrier 22, the goalie pushes one foot off the blocker 22 and t-glides to the other semi-circular blocker 22. Then, the goalie turns his body towards the far post blocker 14 and t-glides in a diagonal direction towards that post blocker 14 after pushing one foot off the semi-circular blocker 22. Finally, the goalie returns to the starting post 14 by pushing one foot off the post barrier 22.

Figure 6D:
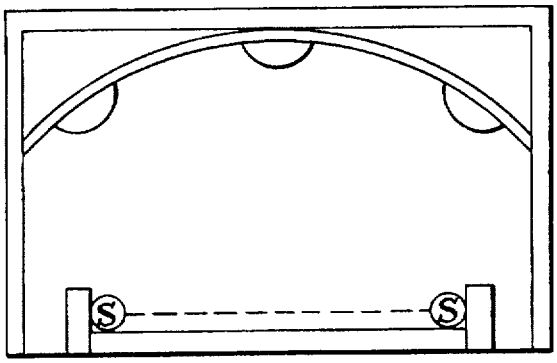
Figure 6B:
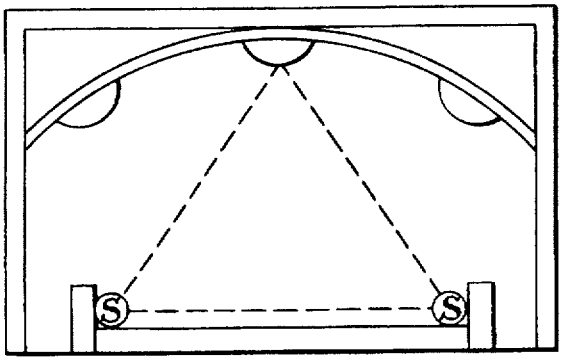

FIG. 6B shows a drill a goalie might use to practice defending a pass from the corner to the slot or a pass from the high slot to the post or corner. First, the goalie stands on the glide surface adjacent to one post barrier 14. After pushing one foot off the adjacent post barrier 14, the goalie t-glides hard toward the middle blocker 22. Once reaching the middle blocker 22, the goalie turns his body toward the other post barrier 14 and pushes one foot against the middle blocker 22. The goalie slides to the other post barrier 14. He returns to the starting post barrier 14 by pushing off the second post barrier 14 and sliding to the first post barrier 14.

Figure 6E:
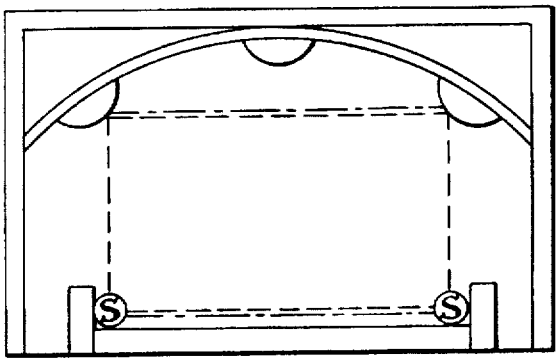
Figure 6C:
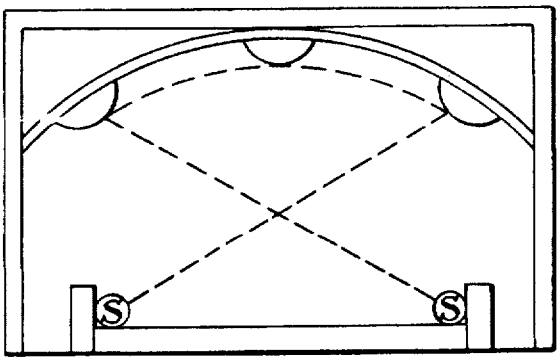

FIG. 6C illustrates a drill for a goalie to practice defending passes to the point, the movement of a defenseman on the blue line, and close movement in the slot area. First, the goalie stands on the glide surface of the slide board 12 adjacent to a post barrier 14. Then, the goalie pushes one foot off the post barrier 14 and t-glides toward a far wedge-shaped blocker barrier 22. Once there, the goalie shuffles along an arc past the middle wedge-shaped blocker barrier 22 to the other wedge-shaped blocker barrier 22. The goalie then turns slightly and t-glides to the opposite post barrier 14 after pushing one foot off the wedge-shaped blocker barrier 22. Finally, the goalie pushes one foot off the post barrier 14 back to the wedge-shaped blocker 22 to retrace the drill pattern in the opposite direction to return back to the beginning post blocker 14.

FIG. 6D illustrates the drill to practice defending the movement of the puck behind the net. The goalie stands on the glide surface of the slide board 12 adjacent to one post blocker barrier 14. He pushes one foot off the adjacent post barrier 14 and t-glides to the opposite post barrier 14. Then he pushes off that post barrier 14 and t-glides back to the starting post 14.

FIG. 6E illustrates how to practice defending the goal against movement of the puck around the perimeter, especially during a power play. The goalie stands on the glide surface of the slide board 12 adjacent to one post barrier 14. The goalie first pushes one foot off the post barrier 14 and t-glides toward the closest wedge-shaped blocker 22. Next, the goalie pushes one foot off that blocker 22 and t-glides to the other wedge-shaped blocker 22. The goalie also might shuffle rather than slide or t-glide from the first wedge/shaped blocker 22 to the second. Next, the goalie pushes one foot off the second wedge-shaped blocker 22 and t-glides to the other post barrier 14. Finally, the goalie t-glides or shuffles back to the starting post 14.

Figure 6F:
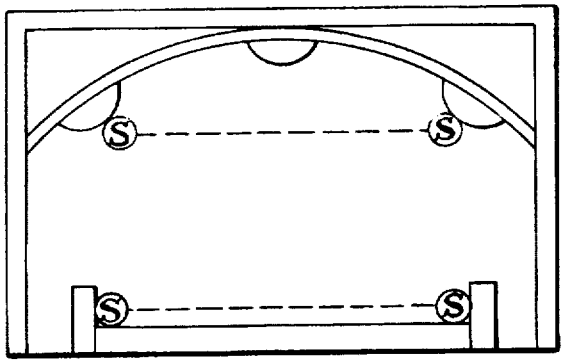

FIG. 6F illustrates a training drill to practice defending slow movement behind the net or movement of the puck on the blue line. The goalie stands on the glide surface either adjacent to a post barrier 14 or adjacent to a wedge-shaped barrier 22. The goalie then shuffles back and forth between the two post barriers 14 or between the two wedge-shaped barriers 22.

While the invention has been described in connection with what are presently considered to be the most practical and preferred embodiments, the invention is not to be limited to these embodiments. The invention is intended to cover various modifications and equivalent arrangements included within the scope of the following claims.

I claim:

1. A goalie training apparatus, comprising:

a slide board having an upper glide surface and a lower surface;

a first plurality of barriers attached to the glide surface in spaced-apart relation along an arc representing an outer boundary of a goal crease, said arc having a convex side and a concave side, wherein each barrier in the first plurality of barriers has a convexly-curved outer surface; and a second barrier attached to the glide surface at a point separated from the first plurality of barriers and on the concave side of the arc leaving a portion of the glide surface of the slide board between the first plurality of barriers and the second barrier unobstructed convexly-curved side surfaces of the barriers of the first plurality of barriers face inwardly on the concave side of the arc and substantially toward the second barrier.

2. The goalie training apparatus of claim 1, further comprising a third barrier attached to the glide surface of the slide board in spaced apart relation from the second barrier and separated from the first plurality of barriers to leave a portion of the glide surface of the slide board between the first plurality of barriers and the third barrier unobstructed, said second and third barriers representing goal posts.

3. The goalie training apparatus of claim 1, further comprising fastener strips attached to the glide surface of the slide board and mating fastener strips attached to the barriers so that the barriers are attached to the glide surface by pressing together the fastener strips.

4. The goalie training apparatus of claim 1, wherein the barriers of the first plurality of barriers are attached to the glide surface in abutting end to end relation.

5. The goalie training apparatus of claim 2, further comprising a back stop barrier attached to the glide surface between the second and third barriers.

6. The goalie training apparatus of claim 5, further comprising fastener strips attached to the glide surface of the slide board and mating fastener strips attached to the backstop barrier so that the backstop barrier is attached to the glide surface by pressing together the fastener strips.

7. The goalie training apparatus of claim 1, wherein at least one barrier in the first plurality of barriers has a substantially straight edge and is attached to the glide surface of the slide board with its substantially straight edge facing away from the second barrier.

8. The goalie training apparatus of claim 1, wherein the second barrier has a substantially rounded vertical face and is attached to the glide surface with the substantially rounded vertical face facing toward the portion of the glide surface between the first plurality of barriers and the second barrier that is unobstructed by barriers.

9. The goalie training apparatus of claim 1, further comprising an arc colored on the glide surface of the slide board so that the first plurality of barriers are attached to the glide surface of the slide board on or adjacent to the colored arc on the glide surface.

10. The goalie training apparatus of claim 1, further comprising a solid base surface to which the lower surface of the slide board is attached.

11. A goalie training apparatus, comprising:

a slide board having an upper glide surface and a lower surface;

a first barrier attached to the glide surface along an arc representing an outer boundary of a goal crease, said first barrier having an inner curved surface conforming to the concave curve of the arc; and a second barrier attached to the glide surface separated from the first barrier leaving a portion of the glide surface of the slide board unobstructed, said second barrier having a substantially convexly-curved edge and positioned so that the substantially convexly-curved edge faces the inner curved surface of the first barrier.

12. A method for using a goalie training apparatus, comprising:

(a) wearing a foot-covering with a low coefficient of friction with respect to an upper glide surface of a slide board;

(b) standing on an unobstructed portion of the glide surface of a slide board that has attached thereto a first plurality of barriers in spaced-apart relation along an arc said arc having a convex side and a concave side, wherein each barrier in the first plurality of barriers has a convexly-curved outer surface;

(c) pushing one foot against the convexly-curved outer surface of a barrier within the first plurality of barriers;

(d) gliding or shuffling on the glide surface; and (e) pushing the other foot against the convexly-curved surface of another barrier within the first plurality of barriers.

13. A method for using a goalie training apparatus, comprising:

(a) wearing a foot-covering with a low coefficient of friction with respect to an upper glide surface of a slide board;

(b) standing on an unobstructed portion of the glide surface of the slide board that has attached thereto (i) a first plurality of barriers positioned in spaced-apart relation along an arc, and (ii) a second barrier separated from the first plurality of barriers, wherein each barrier of said first plurality of barriers has at least one convexly-curved surface;

(c) pushing one foot against the second barrier;

(d) gliding or shuffling on the glide surface; and (e) pushing the other foot against the convexly-curved surface of a barrier within the first plurality of barriers.

14. The method of claim 13, wherein step (e) comprises pushing the same foot against the convexly-curved surface of a barrier within the first plurality of barriers attached to the glide surface in spaced-apart relation along an arc.

15. A goalie training apparatus, comprising:

a slide board having an upper glide surface and a lower surface;

a first plurality of barriers attached to the glide surface in spaced-apart relation along an arc representing an outer boundary of a goal crease, said arc having a convex side and a concave side;

a second barrier defining an axis along its length and attached to the glide surface at a point separated from the first plurality of barriers and on the concave side of the arc leaving a portion of the glide surface of the slide board between the first plurality of barriers and the second barrier unobstructed; and a third barrier defining an axis along its length and attached to the glide surface at a point separated from the first plurality of barriers and on the concave side of the arc leaving a portion of the glide surface of the slide board between the first plurality of barriers and the third barrier unobstructed, and said third barrier positioned in spaced-apart relation from the second barrier along a substantially straight line with the axes of the second and third barriers substantially perpendicular to the straight line.

16. The goalie training apparatus of claim 15, where in the second and third barriers have convexly-curved arcuate outer surfaces.

17. The goalie training apparatus of claim 15, wherein each barrier in the first plurality of barrier has a convexly-curved arcuate outer surface and is positioned so that the convexly-curved arcuate outer surface is directed substantially toward the second and third barriers.

18. The goalie training apparatus of claim 15, further comprising a fourth barrier attached to the glide surface of the slide board at a position spaced-apart from the first plurality of barriers, leaving a portion of the glide surface between the fourth barrier and the first plurality of barriers unobstructed, and attached between the second and third barriers along the substantially straight line defined by the second and third barriers.

19. The goalie training apparatus of claim 18, wherein the fourth barrier has a convexly-curved arcuate outer surface and is positioned so that the convexly-curved arcuate outer surface is facing substantially toward the first plurality of barriers.

* * * * *

UNITED STATES PATENT AND TRADEMARK OFFICE

CERTIFICATE OF CORRECTION

PATENT NO. : 5,800,312

DATED : September 1, 1998

INVENTOR(S) : Thomas Ormondroyd

It is certified that error appears in the above-identified patent and that said Letters Patent is hereby corrected as shown below:

Claim 1, at Column 6, line 46, please insert -- , wherein the -- after "unobstructed".

Signed and Sealed this

Twelfth Day of January, 1999

*Attest:*

*Attesting Officer*

*Acting Commissioner of Patents and Trademarks*

UNITED STATES PATENT AND TRADEMARK OFFICE

CERTIFICATE OF CORRECTION

PATENT NO. : 5,800,312
DATED : September 1,1998
INVENTOR(S) : Thomas Ormondroyd

It is certified that error appears in the above-identified patent and that said Letters Patent is hereby corrected as shown below:

On the cover page, Canadian Patent CA2060969 should be listed among the References Cited, 08/1993.

Claim 1, at Column 6, line 46, please insert -- , wherein the -- after "unobstructed".

Signed and Sealed this

Fourth Day of July, 2000

*Attest:*

Q. TODD DICKINSON

*Attesting Officer*

*Director of Patents and Trademarks*